US008517783B2

(12) United States Patent
Ulgen

(10) Patent No.: US 8,517,783 B2
(45) Date of Patent: Aug. 27, 2013

(54) PROPELLER MECHANISM FOR A MARINE VEHICLE

(76) Inventor: Mehmet Nevres Ulgen, Istanbul (TR)

( * ) Notice: Subject to any disclaimer, the term of this patent is extended or adjusted under 35 U.S.C. 154(b) by 181 days.

(21) Appl. No.: 13/291,605

(22) Filed: Nov. 8, 2011

(65) Prior Publication Data

US 2013/0029544 A1 Jan. 31, 2013

(30) Foreign Application Priority Data

Jul. 27, 2011 (TR) ..... 2011/07378

(51) Int. Cl.
*B63H 23/34* (2006.01)

(52) U.S. Cl.
USPC ..... 440/49; 440/83; 416/244 B

(58) Field of Classification Search
USPC ..... 114/49, 83; 416/245 A, 244 B
See application file for complete search history.

(56) References Cited

U.S. PATENT DOCUMENTS 1,860,750 A * 5/1932 Riggs ..... 464/39
2,569,144 A * 9/1951 Benson ..... 464/44
4,077,742 A * 3/1978 Goodwin ..... 416/245 A
4,295,835 A * 10/1981 Mapes et al. ..... 440/78
4,538,962 A * 9/1985 McCain ..... 416/146 R
4,556,366 A * 12/1985 Sargisson et al. ..... 416/155
4,778,419 A * 10/1988 Bolle et al. ..... 440/89 R
4,869,694 A * 9/1989 McCormick ..... 440/83
4,900,281 A * 2/1990 McCormick ..... 440/78
5,325,662 A * 7/1994 Varney et al. ..... 60/221
5,415,575 A * 5/1995 Karls ..... 440/75

* cited by examiner

*Primary Examiner* — Stephen Avila
(74) *Attorney, Agent, or Firm* — Vidas, Arrett & Steinkraus, P.A.

(57) ABSTRACT

A propeller having a hub with a shaft hole at the center thereof, and a number of blades provided radially around the hub; a shaft connected at one end to a motor driving the marine vehicle, the shaft being adapted to the shaft hole, and having a threaded portion arranged at least partially in the longitudinal direction thereof; at least one bearing provided on the shaft for bearing the propeller to the shaft, the at least one bearing being rotatable in a single direction; a connection hub associated with the hub of the propeller, the connection hub comprising a threaded portion being screwable to the threaded portion of the shaft in the direction opposite to the rotatable direction of the at least one bearing, and being non-screwable to the threaded portion of the shaft in the rotatable direction of the at least one bearing.

11 Claims, 5 Drawing Sheets

PROPELLER MECHANISM FOR A MARINE VEHICLE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a propeller mechanism for a marine vehicle, providing the rotation of the propeller softly at a speed suitable to the current speed of the marine vehicle, in case the motor, the shaft and the propeller attached to it reduce speed or stop. The propeller mechanism of the invention also prevents both the transmission of reverse torque to the motor side and water resistance of the propeller during cruising of the marine vehicle.

The propulsion required for the movement of marine vehicles, such as boats, ships (including sailing boats) is provided by the propeller or propellers. Propellers, in general, comprises a central hub and a number of blades combined with the hub. The surfaces of the blades are generally in helicoidal form and water moving through the propeller is caught by the leading edge of the blade and compressed on the helicoidal surface to form a pressure and then it accelerates over the blade and leaves from the trailing edge to ensure the movement in progress.

The propeller is rotated by a shaft placed in a hole in the middle of the hub and connected to the motor and to its gearbox. As the propeller is directly and rigidly connected to the shaft, the rotation of the shaft in a direction causes the marine vehicle in the forward direction, and rotation of the shaft in the opposite direction causes the marine vehicle to move in the backward direction. The rigid character of the propeller shaft-propeller connection causes a sudden and sharp slow-down of the vessel if the motor is suddenly decelerated or stopped. In cases of a sudden halt from high speeds, depending on the current speed of the vessel, the negative acceleration is sometimes so great that the occupants of the vessel in the sea may feel discomfort due to reaction created. Furthermore, with rigid shaft-propeller connections, problems such as mechanical fatigue, wear may also be experienced as serious reaction forces will be created in case of stopping the motor and transmission.

As far as a sailing boat is concerned, when the motor is not running, water rotates the propeller by applying force on the blades of the propeller to create a reverse torque on the propeller shaft connected to the propeller and causes the rotation of the shaft according to the speed of the sailing boat. In this case, as the motor is not running, lubrication needed by the motor and transmission mechanism will not be possible and unless other remedy and measures are not taken, this can only cause a serious damage on the motor.

Numerous solutions to overcome this problem are proposed in the art, but none of them is economically feasible to be produced. In fact, according to a known solution for the sailboats, the propeller blades are displaced so as to split the water or folded back and the blades are brought back to their original position when the motor power is desired to be utilized. Another solution utilizes clutching valves (trolling valves) to be provided to transmission.

Yet further drawback applies to twin-motor boats. In particular, when one of the motors fails to run, the propeller at the side with the failure, may apply reverse torque to the motor side if no supplementary mechanism is provided for locking the corresponding shaft. This however would not prevent resistance created by the propeller fixed in the water.

BRIEF SUMMARY OF THE INVENTION

It is desirable to minimize the effects of the reaction occurring in a marine vehicle when the motor of the vehicle is stopped from a high speed.

It is also desirable to prevent transmission of reverse torque from the propeller to the motor group.

It is also desirable to provide a drag-free propeller during the course of sailing.

The present invention relates to a propeller mechanism comprising:

a propeller having a hub with a shaft hole at the center thereof, and a number of blades provided radially around the hub;

a shaft connected at one end to a motor driving the marine vehicle, the shaft being adapted to the shaft hole, and having a threaded portion arranged at least partially in the longitudinal direction thereof;

at least one bearing provided on the shaft for bearing the propeller to the shaft, the at least one bearing being rotatable in a single direction;

a connection hub associated with the hub of the propeller, the connection hub comprising a threaded portion being screwable to the threaded portion of the shaft in the direction opposite to the rotatable direction of the at least one bearing, and being non-screwable to the threaded portion of the shaft in the rotatable direction of the at least one bearing.

The shaft comprises a recess being coaxial with the axis of the shaft, and being formed at its remote end from the motor. Thus the shaft has an inner diameter along this recess. The threaded portion of the shaft is formed in the circular surface of this inner diameter and the threads are formed at least partially along the shaft axis.

The connection hub is an elongate member having a threaded portion at one end, and is connected to a tapering component from its other end having a hexagonal cross-section. The tapering component is connected to the propeller hub. As the connection hub is screwed to the shaft in the rotatable direction of the bearing, power transmission becomes possible, whereas in the opposite direction where the bearing cannot rotate (i.e. locked position), the power transmission is not possible, since the connection hub is not screwed to the shaft. There is a spring in between the shaft and the connection hub, extending along the axis of the shaft in the shaft cavity. This spring pushes the connection hub continuously towards the tapering.

Through the propeller mechanism of the invention, as the bearing(s) will not be in the locked position when the motor is stopped, the propeller will not stop immediately together with the shaft and will continue to rotate freely in line with the water flow rate. Thus, the formation of a high level reaction upon stopping of the motor and the shaft is prevented in order to provide a smooth transition to a stand-still position.

On the other hand, in cases the marine vehicle sails in the water without being driven by the motor (e.g. driven by sail), since the propeller will rotate in the direction of rotation of the bearings and since this direction of rotation is at the same time the direction of rotation when the connection hub is not screwed to the shaft, reverse torque transmission from the propeller to the motor side is also prevented.

The propeller hub mechanism in accordance with the invention also provides a relatively low cost and simple construction wherein the propeller mechanism is essentially structured within the hub, and having a closed system and protected by a lubricated arrangement.

BRIEF DESCRIPTION OF THE SEVERAL VIEWS OF THE DRAWINGS

The present invention should be evaluated together with the below explained figures in order to provide the configuration and understanding of its advantages with the additional elements in the best way.

DETAILED DESCRIPTION OF THE INVENTION

Figure 1:
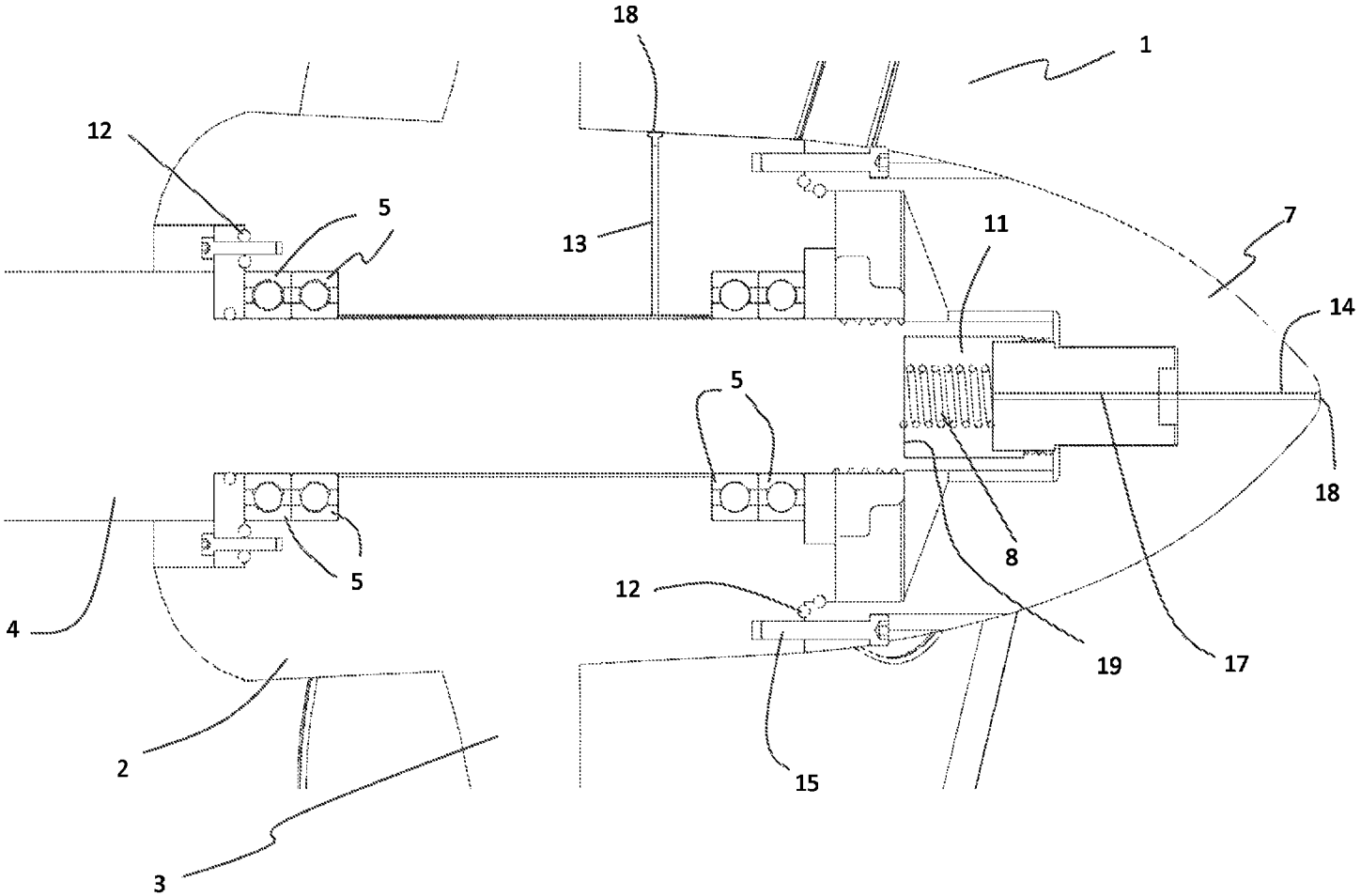
FIG. 1 shows the cross-sectional view of the propeller mechanism when the shaft threads and the connection hub threads are screwed to each other.
Figure 2:
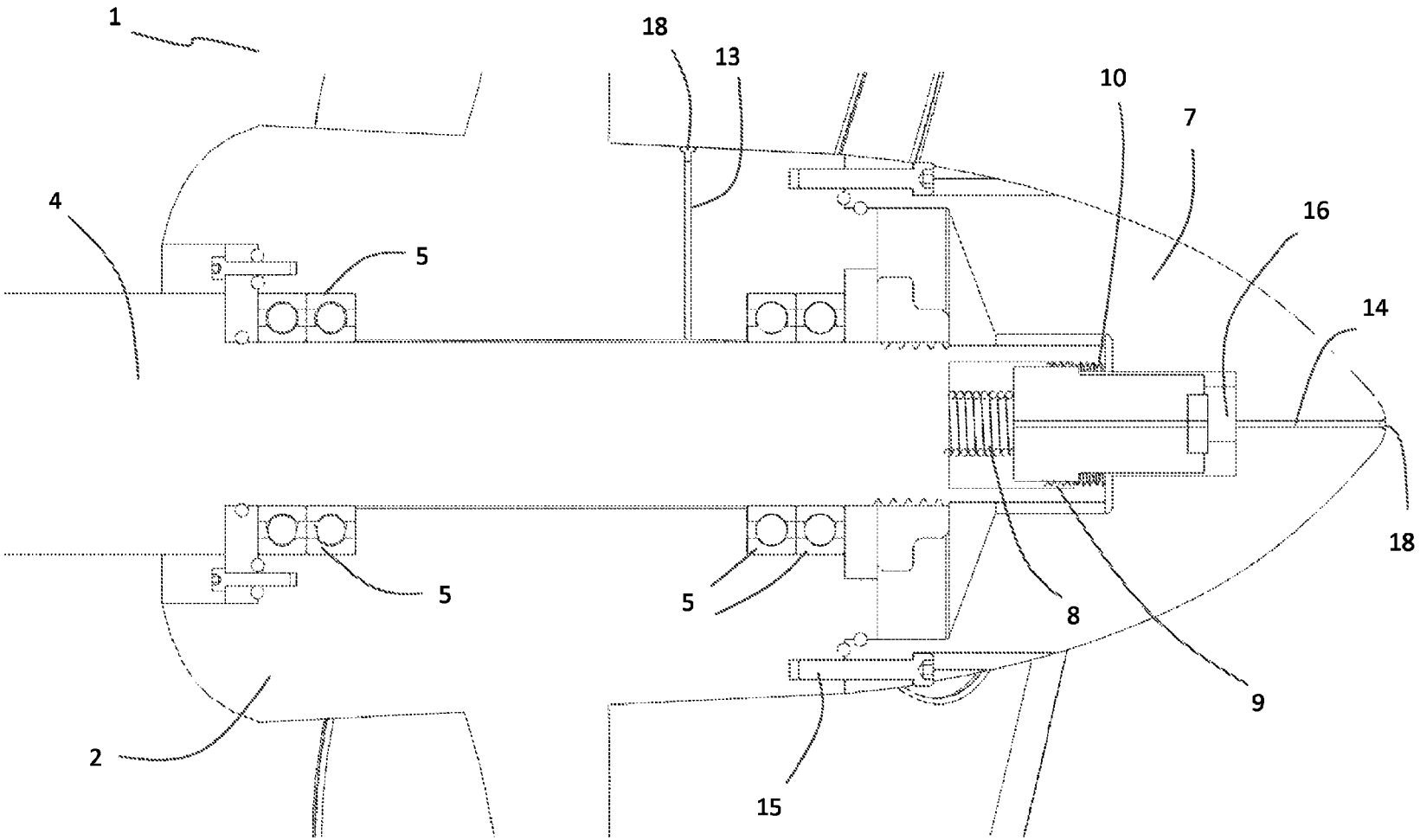
FIG. 2 shows the cross-sectional view of the propeller mechanism when screw connection between the shaft and the connection hub threads is off.
Figure 3:
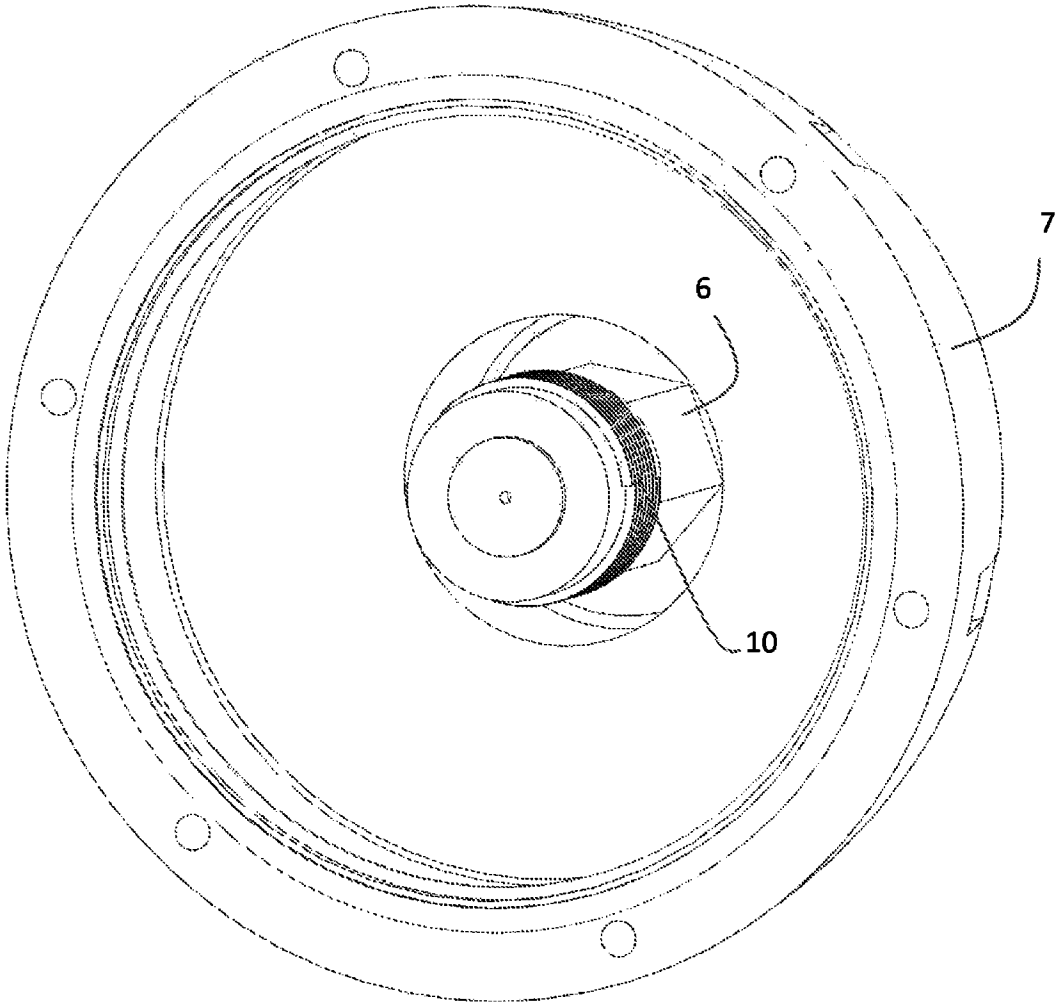
FIG. 3 shows the perspective view of the tapering component with the connection hub located at its center.
Figure 4:
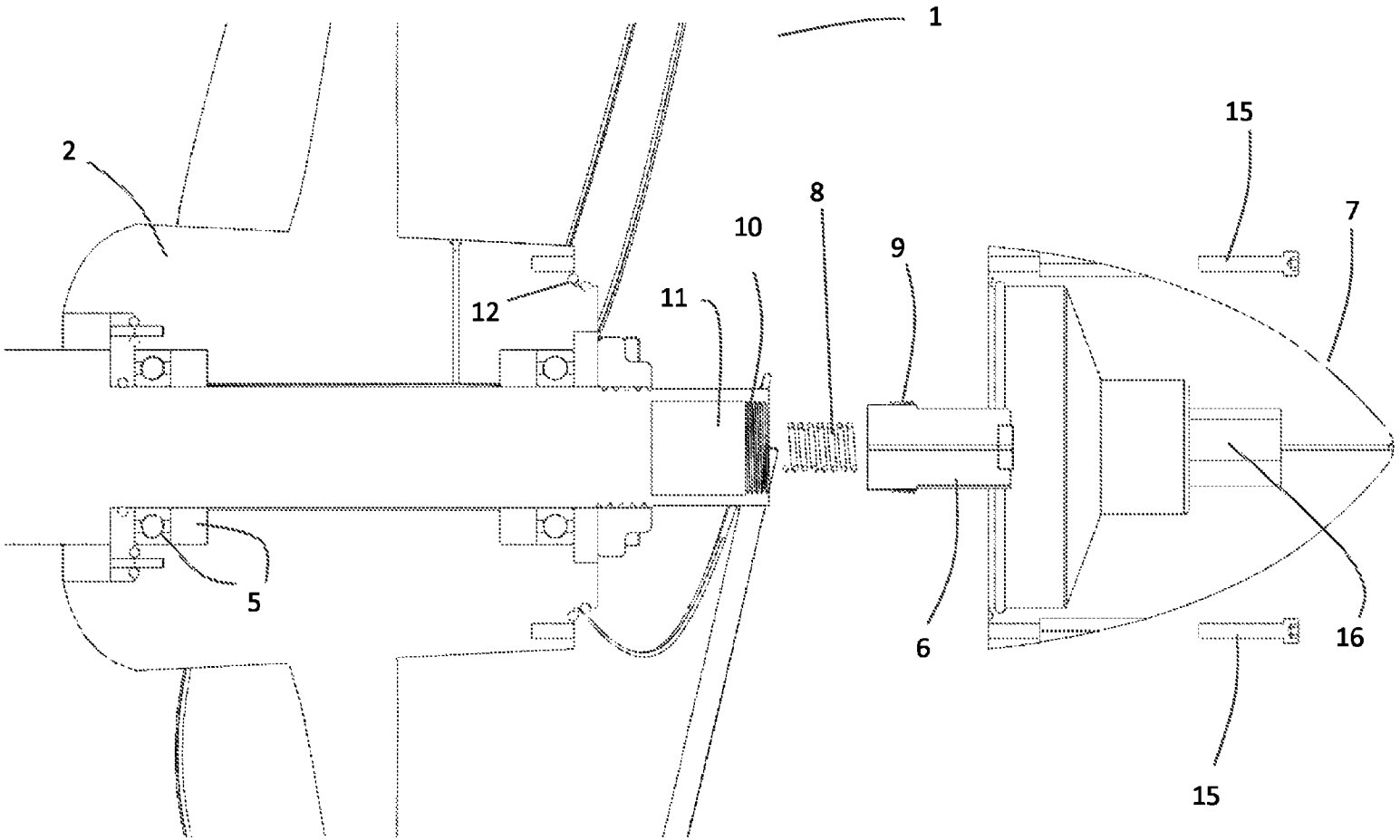
FIG. 4 shows the cross-sectional view of the connection hub and the tapering component separate from the propeller.
Figure 5:
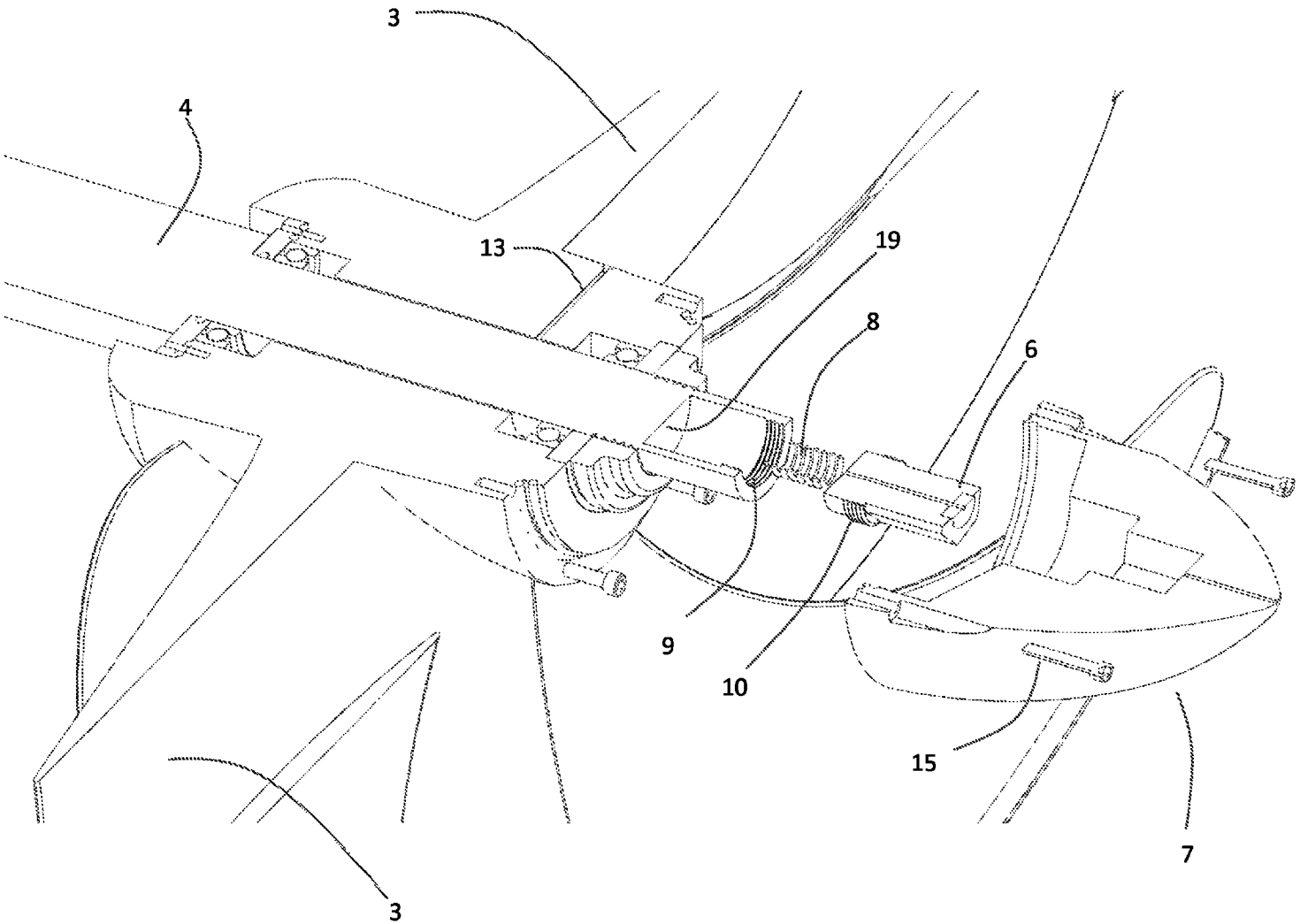
FIG. 5 is a perspective cross-sectional view of FIG. 4.

While this invention may be embodied in many different forms, there are described in detail herein a specific preferred embodiment of the invention. This description is an exemplification of the principles of the invention and is not intended to limit the invention to the particular embodiment illustrated As shown in FIG. 1, the propeller mechanism according to the present invention comprises, a propeller (1) having a number of blades (3) radially arranged around a hub (2), bearings (5) disposed in holes being at the center of the hub (2) of the propeller (1), and a shaft (4) running through the hole at the center of the bearings (5), the shaft transmitting the rotational motion from the motor to the propeller (1). The propeller (1) is therefore borne through the bearings (5) on the shaft (4). The shaft (4) is borne preferably by two distantly located bearings (5). The bearings (5) are of the type that allows rotation only in one direction, and is locked for the other direction of rotation.

A recess (11) which is coaxial with the shaft (4) axis is formed at the distal end of the shaft, away from the motor. A threaded portion (9) is formed by opening female threads along a certain distance to the circular surface of the recess (11) in the shaft axis direction. The threaded portion (9) of the shaft and a connection hub (6) with a male threaded portion (10) formed on the outer surface are screwed to each other, according to the direction of rotation of the shaft (4), so that power transmission can occur between these members. It is to be appreciated that the threads opened on the shaft (4) may be male, and those on the connection hub (6) may be female.

The connection hub (6) is a longitudinal component like a small shaft, and the cross-section of the connection hub (6) at its unthreaded side is of a polygon form, such as hexagonal or pentagonal. The connection hub (6) is connected with a tapering component (7) at the side of the unthreaded end. This tapering component (7) is in rigid connection with the hub (2) by means of bolts (15). It is to be appreciated that the tapering component (7) can be integrated with the hub (2) if desired. The external form of the tapering component (7) becomes more tapered as it is away from the hub (2), so the resistance force on the propeller of the water flowing over the outer surface of the tapering component (7) is minimized.

A shaft recess frontal face (19) lies at the side where the shaft cavity (11) ends towards the motor side and a spring (8) extending along the shaft (4) axis is placed between the frontal face (19) and the connection hub (6). Being between the connection hub (6) and the frontal face of the shaft recess (19), the spring (8) continuously pushes the connection hub (6) towards the tapering (7) side. Since the threads at the threaded portion (9) of the shaft are compatible with the threads at the threaded portion (10) of the connection hub, the connection hub (6) is screwed to the shaft (4) in one direction of rotation of the shaft (4), and in the other direction of rotation of the shaft (4), the connection hub (6) is released from the screw connection with the shaft (4). Therefore, the connection hub (6) can be displaced in the axial direction within the shaft recess (11) and so within the tapering recess (16). The cross-sectional form of the tapering recess (16) is compatible with the polygonal cross-sectional form of the connection hub (6) at the unthreaded side i.e. cross-sectional form of the tapering recess (16) is the same with the cross-sectional form of the connection hub (6) at the unthreaded side. Therefore, the tapering recess (16) bears the connection hub (6).

As the bearings (5) allow rotation in single direction, power is transmitted over the shaft (4) to the propeller (1) in the direction where the bearings (5) are locked, thus the propeller enables the marine vehicle to move forwards. The rotational direction where the bearings (5) are locked, is the direction of rotation where the connection hub (6) is released from the screw connection to the shaft. In this case, while the power from the motor is transmitted over the shaft (4) (and over the locked bearings (5)) to the propeller, no rotational motion is transmitted to the connection hub.

As the bearings (5) will not be locked by the rotation of the shaft in the opposite direction, no power will be transmitted over the shaft (4) to the propeller (1), however in this case, the threads of the hub (10) screw with the threads on the shaft (4) and thus the propeller rotates in the opposite direction to enable the backwards movement of the marine vehicle.

When the motor is stopped during the forward movement of marine vehicle, the shaft (4) is terminated to rotate, so the bearings (5) become unlocked, but the propeller continues to rotate for a while due to its kinetic energy, because as soon as the motor stops there remains no reason to prevent the rotation of the propeller (1). Thus, the rotational speed of the propeller is smoothly reduced, which eliminates the sudden reaction force that occurs by stopping the motor. This is similar to shifting down in a car being driven in high-speed to shift to a low-speed cruise.

In case the motor is non-operative, the torque transmission to the motor side through the propeller that is dragged in water by the forward movement of a marine vehicle is prevented by the propeller mechanism of the present invention. When dragged in water, the propeller rotates freely in the direction the bearings (5) can rotate, therefore no power transmission occurs over the bearings (5) to the shaft (4). Power transmission does not occur over the connection hub (6) too, because the rotational direction of the propeller (1) is the direction where the threads at the threaded portion (10) of the connection hub are not screwed to the threads at the threaded portion (9) of the shaft.

As can be seen in the figures, the mechanism that provides the rotation of the propeller (1) for a while when the motor is stopped and at the same time prevents the transfer of the reverse torque to the motor side when the motor is non-operative, is arranged in the propeller hub (2).

The propeller mechanism according to the invention also comprises a lubrication arrangement for the lubrication of the bearings (5) in the hub (2) and the shaft (4) and connection hub (6) threads. Accordingly, a lubrication channel (13) is provided at the hub (2), radially from the outer circular surface of the hub (2) down to a hub opening where the shaft (4) is located. The diameter of the hub opening is slightly larger than the outer diameter of the shaft (4) and the oil from the lubrication channel (13) is transferred to the bearings (5), through the gap between the hub opening and the outer diameter of the shaft. Oil is also transferred to the threaded portion (9) of the shaft and to the threaded portion (10) of the connection hub to provide the lubrication of the threads. In order to check if a sufficient amount of oil was put into the hub (2), a connection hub oil transfer channel (17) opened along the axis of the connection hub (6) and an oil discharge channel (14) opened to the tapering (7) along the axial direction are formed. Lubricating can be terminated when the excess oil put into the lubrication channel (13) start to be drained from the oil discharge channel (14). The exit hole of the oil discharge channel (14) and the entry hole of the lubrication channel (13) are covered with plugs (18) to avoid any more draining of oil during operation. Also, O-rings (12) are fitted in various suitable parts of the propeller mechanism, to prevent any oil leakage after lubrication is made.

This completes the description of the preferred and alternate embodiments of the invention. Those skilled in the art may recognize other equivalents to the specific embodiment described herein which equivalents are intended to be encompassed by the claims attached hereto.

What is claimed:

1. A propeller mechanism comprising:

a propeller (1) having a hub (2) with a shaft hole at the center thereof, and a number of blades (3) provided radially around the hub (2);

a shaft (4) connected at one end to a motor driving the marine vehicle, the shaft (4) being adapted to the shaft hole, and having a threaded portion (10) arranged at least partially in the longitudinal direction thereof;

at least one bearing (5) provided on the shaft (4) for bearing the propeller (1) to the shaft (4), the at least one bearing (5) being rotatable in a single direction;

a connection hub (6) associated with the hub (2) of the propeller (2), the connection hub (6) comprising a threaded portion (9) being screwable to the threaded portion (10) of the shaft (4) in the direction opposite to the rotatable direction of the at least one bearing (5), and being non-screwable to the threaded portion (10) of the shaft (4) in the rotatable direction of the at least one bearing (5).

2. A propeller mechanism according to claim 1, wherein the shaft (4) comprises a recess (11) at the distal end thereof being away from the motor, the recess (11) being coaxial with the shaft axis and the connection hub (6) being displaceable in an axial direction of the recess (11).

3. A propeller mechanism according to claim 1, wherein the threaded portion (9) of the shaft (4) is located at the circular surface of the recess (11) and in an axial direction of the shaft (4).

4. A propeller mechanism according to claim 3, wherein the threads at the threaded portion (9) of the shaft (4) are female.

5. A propeller mechanism according to claim 1, further comprising a spring (8) provided between a frontal surface (19) of a shaft recess (11) being at the end towards the motor side, and the connection hub (6).

6. A propeller mechanism according to claim 1, wherein the connection hub (6) comprises a longitudinal form and an unthreaded portion, the cross-section of which has a polygonal form.

7. A propeller mechanism according to claim 1, further comprising a tapering component (7) rigidly connected the hub (2), tapering component (7) bearing the unthreaded end of the connection hub (6).

8. A propeller mechanism according to claim 1, wherein the tapering component (7) comprises a tapering recess (16) having a cross-sectional form compatible with the polygonal cross-section form of the connection hub (6), and the connection hub (6) being displaceable in an axial direction in the recess (16).

9. A propeller mechanism according to claim 1 further comprising a lubricating arrangement.

10. A propeller mechanism according to claim 9, wherein the lubrication arrangement comprises a lubrication channel (13) provided radially at the hub (2) from the outer circular surface of the hub (2) down to a hub opening where the shaft (4) is located hub (2).

11. A propeller mechanism according to claim 9, wherein the lubrication arrangement comprises a connection hub oil transfer channel (17) opened along the axis of the connection hub (6) and an oil discharge channel (14) opened to the tapering (7) along an axial direction.

* * * * *